United States Patent [19]

Voswinkel

[11] Patent Number: 4,759,241

[45] Date of Patent: Jul. 26, 1988

[54] SCREW DRIVER

[76] Inventor: Egon Voswinkel, Ulrichstrasse 3a, 8901 Stettenhofen, Fed. Rep. of Germany

[21] Appl. No.: 942,117

[22] Filed: Dec. 16, 1986

[30] Foreign Application Priority Data

Jan. 16, 1986 [DE] Fed. Rep. of Germany ..... 3601129

[51] Int. Cl.[4] ..... B25B 23/10

[52] U.S. Cl. ..... 81/453; 81/455

[58] Field of Search ..... 81/455, 453, 452, 454, 81/456–458, 451, 125

[56] References Cited

U.S. PATENT DOCUMENTS

| | | | |
|---|---|---|---|
| 604,250 | 5/1898 | Jocelyn | 81/455 |
| 2,490,211 | 12/1949 | Dausch | 81/453 |
| 2,534,719 | 12/1950 | Lohr | 81/455 |
| 3,710,835 | 1/1973 | Eby | 81/455 |

*Primary Examiner*—Frederick R. Schmidt
*Assistant Examiner*—Bradley I. Vaught
*Attorney, Agent, or Firm*—Jones, Tullar & Cooper

[57] ABSTRACT

In a screw driver with a turning tool placed at the front end of a shank which is torsionally connected with a handle, the turning tool can be reliably prevented from slipping off the head of the screw to be turned by the fact that the turning tool is embraced by a jaw chuck with at least two holding jaws in the form of spring arms of a shifter collar which can be moved in the axial direction on the shank, the spring arms being spreadable in the radial direction against their inherent elasticity by means of butting faces of the shank, and fixable against each other by means of a cooperating radial locking gear which can be released by butting faces of the shank. The shifter collar is fixable against the shank by means of a cooperating axial locking gear, and is connected with a control element which can be moved in the axial direction against the shank, has a limited relative movability against the shifter collar, and is provided with butting faces releasing the axial locking gear.

19 Claims, 2 Drawing Sheets

Figure 1:
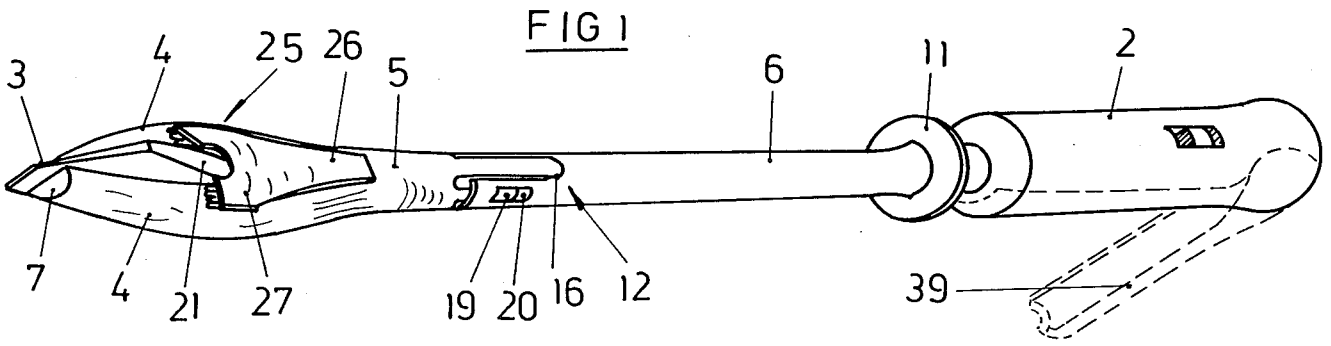

FIG 4
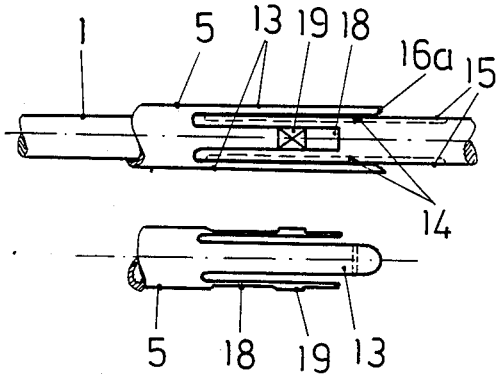
FIG 6
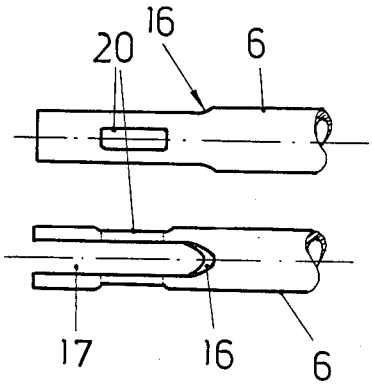
FIG 5
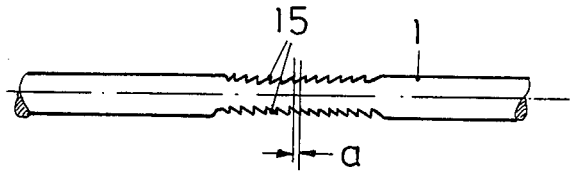
FIG 7
FIG 8
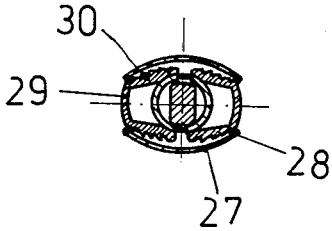
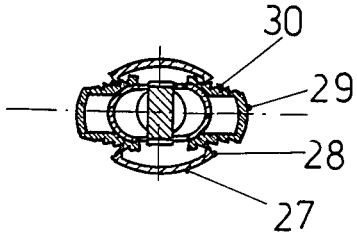
FIG 10
FIG 9
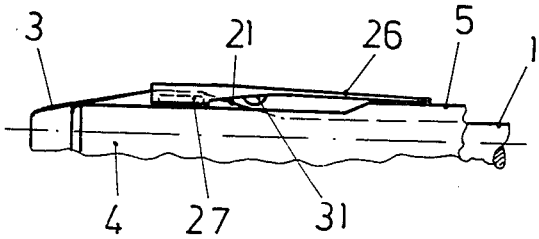
FIG 11

SCREW DRIVER

BACKGROUND OF THE INVENTION

The present invention relates to a screw driver with a turning tool placed at the front end of a shank which is torsionally connected with a handle.

Often great strength is required to screw or respectively unscrew single-slotted or cross-slotted screws. In doing so, there is the danger of the turning tool slipping off the head of the screw, which not only leads to injury and/or damage of the parts to be connected with each other but also to wear on the edges of the slit thus making further use of the screw impossible or in any case more difficult.

SUMMARY OF THE INVENTION

It is therefore the object of the present invention to design a screw driver of the above stated kind, which can be secured against slipping off the head of the screw in question, and can nevertheless be simply and easily used.

In order to effect this object, the turning tool is embraced by a jaw chuck with at least two holding jaws in the form of spring arms of a shifter collar which can be moved in axial direction on the shank, the spring arms being spreadable in radial direction against their inherent elasticity by means of butting faces of the shank, and fixable against each other by means of a cooperating radial locking gear which can be released by butting faces of the shank, and the shifter collar being fixable against the shank by means of a cooperating axial locking gear, and being connected with a control element which can be moved in the axial direction against the shank, has a limited relative movability against the shifter collar, and is provided with butting faces releasing the axial locking gear.

The advantage of this design is the creation of a holding mechanism cooperating with the turning tool, which makes sure that the screw, by means of the screw driver of the invention, cannot only be screwed or respectively unscrewed but can, at the same time, also be held tight mechanically. This guarantees that, in order to screw or respectively unscrew a screw, no permanent strong pressure has to be used on the latter, which facilitates use and favors a great torque without the danger of the turning tool slipping off the head of the screw. The cooperating radial locking gear in the jaw chuck conveniently ensures the holding jaws in the form of spring arms being fixed against each other when they engage with the head of the screw, and being unable to move away radially even if strong lateral forces are in effect, which results in the tip of the turning tool being held properly in the cooperating slit of the head of the screw. The same holds true for the axial locking gear cooperating with the shifter collar, by means of which the axial position of the shifter collar and therefore the jaw chuck is secured in relation to the shank and the turning tool. The control element cooperating with the shifter collar can be conveniently activated from the handle whereby, with the control element being moved forwards, due to its relative motion in relation to the shifter collar, first the cooperating axial locking gear is released and then the shifter collar together with the jaw chuck can be moved forwards in relation to the shank and the turning tool. The advantage of this relative motion as to the shank is the self acting release of the readial locking gear cooperating with the holding jaws of the jaw chuck, and the spreading of the holding jaws of the jaw chuck which are in the form of spring arms. When the control element is pulled back, these procedures take place in reverse order and direction resulting in the turning tool being held tight in the cooperating slit of the head of the screw. It is another advantage of this design that the screw can already be set in position or respectively taken off by means of the screw driver provided with the holding mechanism in question, i.e. also in positions hardly accessible by hand, so that there is no danger of the screw falling down.

As part of a convenient further development of the invention, the control element can be in the form of a sleeve which surrounds the shank and is connected with the shifter collar via a longitudinal guide preferably in the form of a pin slit connection and defined in axial direction by stops spaced apart from each other. This results in a simple and reliable accommodation of the control element on the shaft whereby, by means of the longitudinal guide which ensures a limited relative motion between the control element and the shifter collar, a mutual security against turning is achieved at the same time.

In accordance with another convenient development of the invention, the shifter collar, for forming the axial locking gear, has at least one locking tooth accommodated on a spring tongue which juts out at the back and is underrun wedgelike by a butting face of the control element, the locking tooth cooperating with a respective teeth line of the shank of a length corresponding with the possible motion of the shifter collar. This conveniently results in a form-closed sleeve locking gear able to receive strong forces. Due to the accommodation of the locking tooth on a cooperating spring torque, it is at the same time guaranteed that the locking tooth can be lifted out of the cooperating teeth line simply by means of a wedgelike butting face, and, self-actingly, can be brought back into the respective engagement due to the inherent eleasticity of the cooperating spring tongue.

For this purpose, it is convenient to have two preferably opposite spring tongues provided with a locking tooth each and two teeth lines which cooperate with them and of which the teeth are staggered at approximatley half a tooth space. This makes sure that the teeth which guarantee a form-closed connection can be of relatively great thickness and therefore high stability, and that nevertheless stop locations to each other can be achieved so that, with the shifter collar fixed in its axial position, the turning tool engages tightly with the cooperating slit of the head of the screw.

As part of a further convenient development of the invention, the sleeve forming the control element can have a surrounding ring at the beginning of the handle and set off therefrom. This makes it easier to use the control element by means of the thumb of the hand embracing the handle.

In accordance with a convenient further development of the invention, the control element, preferably at the end engaging with the handle, can be supported against the shank by means of a return spring. This makes sure, that, when there is no engagement with a screw head, the control element together with the shifter collar and the jaw chuck are automatically brought back to the initial position in which the screw driver of the invention can be used like a conventional screw driver. At the same time, the control element together with the shifter collar and the jaw chuck and be easily secured against turning on the shaft by the spring support of the shank in the form of at least one pin passing through a cooperating slit of the sleeve.

As part of a further particularly advantageous development of the invention, the shifter collar, for forming the radial locking gear, can have at least one bridge situated at the front end of a spring tongue which is placed between two spring arms and underrun wedgelike by a butting face of the shaft, the bridge bridging the distance between two spring arms and accommodating at its lateral ends a locking tooth each which cooperates with a teeth line of the respective cooperating spring arm, the teeth line running in radial direction and being of a length which corresponds to the radial set out of the spring arms. This results in a form-closed design of the radial locking gear cooperating with the holding jaws of the jaw chuck, with the radial locking gear able to receive strong forces. The spring tongues accommodating the bridges which bridge the distance between the holding jaws like a brace, for lifting the locking teeth out of the cooperating teeth lines, can be spread against their inherent elasticity by wedgelike butting faces so that an automatic engagement ensues when the cooperating butting faces effect the respective release. The bridges bridging the distance between the spring arms, in the engaged position, form a tight brace between the holding jaws thus holding them reliably even if there are strong radial forces. At the same time, it is guaranteed that the inherent elasticity of the spring arms can have relatively soft spring characteristics, which makes use easier.

It is convenient to have only two spring arms opposite each other whereby the shank can be flattened at the front end reaching between the two spring arms, and, for forming lateral wedgelike butting faces, can be of a convex shape at the lateral edges of the flattening. This conveniently results in simple development and production of the butting faces for spreading the spring arms, and of the spring tongues accommodating the bridges. The spring arms can thereby, at the side of the sleeve, converge in the form of wedgelike narrowing slits and which engages the shank by its convex lateral edges so that, when these edges abut the lateral edges of the spring arms, the called for spreading of the spring arms ensues. The spring tongues accommodating the bridges can have actuating dogs which come to rest against the cooperating butting faces. This is a simple solution of how to achieve the called for delay of the release of the radial locking gear and the spreading of the spring arms forming the holding jaws.

In order to give the spring arms forming the holding jaws a great inherent elasticity, they can have stiffening ledges which reach through their teeth lines and taper at the front and back ends. The elasticity of the spring arms forming the holding jaws is conveniently restricted to the cross section of contact so that strong forces can be received when the radial locking gear is engaged.

In accordance with another particularly convenient development of the invention, the spring arms forming the holding jaws can have undercut holding claws at their front ends. This design results in a pincerlike engagement of the holding jaws with the respective screw head.

Further useful effects of the invention and convenient outgrowths thereof will be seen from the following detailed account of one particular working example to be described in detail with reference to the accompanying drawing.

Figure 2:
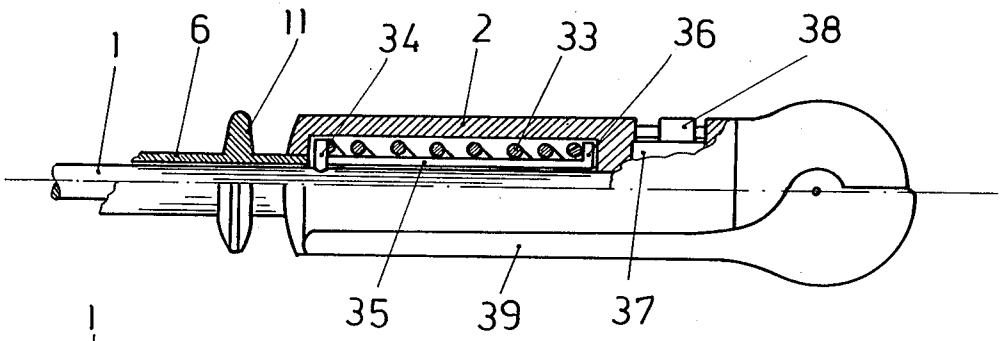
Figure 3:
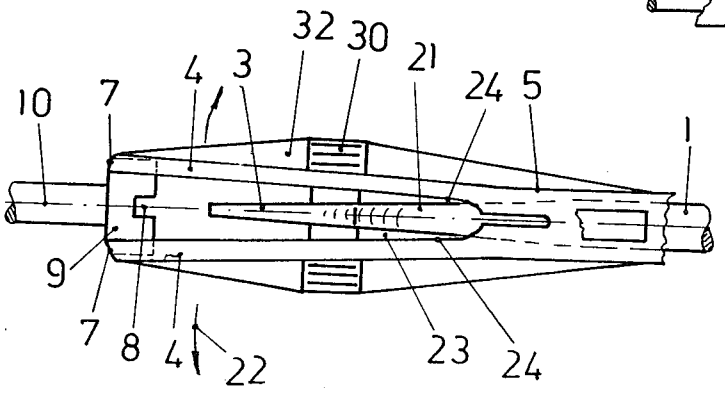

The figures in the drawing are:

FIG. 1, a perspective total view of the screw driver of the invention,

FIG. 2, an enlarged, partly sectional view of the handle end,

FIG. 3, an enlarged view of the jaw chuck end with the bridge of the radial locking gear taken away, FIG. 4, an enlarged view of the back end of the shifter collar, FIG. 5, a lateral view of the design of FIG. 4, FIG. 6, an enlarged view of the front end of the control element engaging with the shifter collar, FIG. 7, a lateral view of the design of FIG. 6, FIG. 8, a view of the toothed section of the shank, FIG. 9, a radial section at radial locking gear through the jaw chuck end of the screw driver with the holding jaws spread, FIG. 10, the design of FIG. 9 with the holding jaws engaged, and FIG. 11, a lateral view of the design of FIG. 3 with the shifter collar pulled back.

DETAILED ACCOUNT OF WORKING EXAMPLE OF THE INVENTION

The screw driver of the invention, as can best be seen in the FIGS. 1 to 3, consists of a shank 1 which is formed by a metal rod etc, is, at its back end, torsionally connected with a handle 2, and, at its front end, has a turning tool 3 which here is formed by a wedgelike taper in the shank 1 and is in the form of a simple blade. The turning tool 3 is flanked by two holding jaws 4 which form a jaw chuck and are in the form of frontways jutting out arms of a shifter collar 5 surrounding the shank 1. The shifter collar 5 can be moved in the axial direction by means of a control element 6 which is coaxial thereto and has the form of a sleeve surrounding the shank 1. As can best be seen in FIG. 3, the front ends of the holding jaws 4 are in the form of undercut holding claws by means of which the head 9 of the screw 10 to be turned, which has a slit 8 cooperating with the turning tool 3, can be grasped in a pincerlike action.

FIG. 1 shows a normal position with the turning tool 3 projecting over the front ends of the holding jaws 4. In this position, the screw driver in question can be used like a conventional screw driver. In order to grasp the head 9 of the screw 10, the shifter collar 5 together with the holding jaws 4 are moved forward on the shank 1 and set out in the radial direction. After the holding jaws 4 being positioned at the head 9 of the screw 10, the shifter collar 5 is pulled back causing first the holding jaws 4 to engage with the head 9, as can be seen in FIG. 3. Then, with the shifter collar 5 being pulled further back, the turning tool 3 engages with the slit 8. In order to make use easier, the control element 6 for moving the shifter collar 5 has, at the front of the handle 2*a*, in this case surrounding, ring 11 attached thereto which serves as point of engagement for the thumb of the hand embracing the handle 2.

The shifter collar 5 can be fixed in the axial direction in relation to the shank 1 by means of a cooperating axial locking gear 12, and can be moved in the axial direction only when the locking gear 12 is released. As can best be seen in FIG. 4, in order to form the axial locking gear 12, the shifter collar 5 has two spring tongues 13 which are opposite each other and have each a locking tooth 14 projecting at the inside. The shank 1 has teeth lines 15 which cooperate with the locking teeth 14 and the length of which corresponds approximately to the possible axial motion of the shifting collar 5. The locking teeth 14 and the teeth of the lines 15 are in the form of saw teeth and are so arranged that, with the axial locking gear 12 engaged, the shifter collar 5 can only be moved backwards but not forwards. For releasing the axial locking gear 12, the spring tongues 13 are set out so far in the radial direction that the locking teeth 14 get out of engagement with the teeth of the respective cooperating teeth line 15. As can best be seen in the FIGS. 6 and 7, the control element 6, for this purpose, has appropriate wedgelike butting faces 16 cooperating with the spring tongues 13 and reaching below them, and can be adequately moved in the axial direction in relation to the shifter collar 5. In the working example shown here, the spring tongues 13 engage with slits 17 of the sleeve forming the control element 6, which are open at the front and of which the back is chamfered in order to form the butting faces 16. As can best be seen in FIG. 4, in this working example also the back ends of the spring tongues 13 are chamfered wedgelike in order to form counter butting faces **16*a* cooperating with the wedgelike butting faces 16. This guarantees a particularly soft handling of the spring tongues 13**.

For spreading the spring tongues 13 by mutual sliding of the butting faces 16 or respectively **16*a*, the control element 6 can be moved in relation to the shifter collar 5 before the latter itself is moved. The relative possible motion of the control element 6 in relation to the shifter collar 5 is axially defined by stops where a driving action ensues. In the working example shown here, there is for this purpose a pin slit connection forming a longitudinal guide. As can best be seen in FIG. 5, the shifter collar 5, for this purpose, has guide jaws 19 which are accommodated on spring ledges 18 jutting out at the back and staggered at 90° in relation to the spring tongues 13, and engage with a respective cooperating long hole 20 of the sleeve forming the control element 6. As soon as the guide jaws 19 abut the axial ends of the respective cooperating long hole 20, the shifter collar 5 is driven by the control element 6**.

As can be seen in FIG. 8, the teeth of the teeth lines 15 of the shank 1 are staggered in the axial direction at approximately half a tooth space a. This makes sure that the coincidingly opposite locking teeth 14 of the two spring tongues 13 engage in turn with the respective cooperating teeth line 15 so that, even when relatively thick teeth are used, comparatively close stop locations result. This offers the advantage of the front tip of the turning tool 3 staying in firm engagement with the cooperating slit 8 of the head 9 of the screw 10 with the sifter collar 5 moved back and the axial locking gear 12 engaged.

As indicated by arrows 22 in FIG. 3, the holding jaws 4, which are in the form of arms of the shifter collar 5, can be set out in the radial direction against their inherent elasticity by the effect of butting faces 21 provided at the shank 1 when the shifter collar 5 is moved forwards. In order to form the wedgelike butting faces 21, the shank 1, at its front end which reaches between the holding jaws 4 and, for forming the turning tool 3, is at the same time flattened, is so widened that outwardly convex lateral edges result. The backward flanks of these convex widenings form the butting faces 21. The spring arms forming the holding jaws 4 converge wedgelike at the start of the shifter collar 5 so that slits 23 result which are narrowed towards the back and with which engages the shank 1 by its convex widenings containing the butting faces 21. When the shifter collar 5 is moved forwards, the butting faces 21 with their lateral edges abut the lateral edges 24 of the spring arms forming the holding jaws 4 thereby spreading the spring arms against their inherent elasticity.

The holding jaws 4 which, even the shifter collar 5 is pulled back, due to their inherent elasticity come to rest either against the head 9 of the screw 10 or against the front end of the shank 1, are secured against moving away radially by means of a radial locking gear indicated in its entirety as 25 in FIG. 1, and can be moved in the radial direction only when the locking gear 25 is released. As can best be seen in FIGS. 1 and 11, for forming the radial locking gear 25, the shifter collar 5 has spring straps 26 which jut out at the front, are situated between the spring arms forming the holding jaws 4, and carry each a bridge 27 bridging the distance between the holding jaws 4 caused by the slits 23. As can be seen in FIGS. 9 and 10, these bridges 27 have each a locking tooth 28 at their lateral ends. The holding jaws 4 are thickened in the radial direction at the bridges 27 and, at the lateral edges of these thickenings 29 have teeth lines 30 cooperating with the locking teeth 28 of the bridges 27. The radial length of the teeth lines 30 approximately corresponds to the radial set out of the spring arms forming the holding jaws 4. As can also be seen in FIGS. 9 and 10, the locking teeth 28 of the bridge 27 and the teeth of the teeth lines 30 cooperating with them have the form of saw teeth and are so arranged that, with the radial locking gear 25 engaged, the holding jaws 4 can only be moved towards each other but not away from each other. As can best be seen in FIG. 11, for disengaging the locking teeth 28 from the cooperating teeth lines 30, the spring straps 26 have each an actuating dog 31 which projects at the inside and, when the shifter collar 5 is moved forwards, abuts the respective adjacent, wedgelike butting face 21 of the shank 1. This makes the spring straps 26 move out in the radial direction so that the locking teeth 28 get out of engagement with the cooperating teeth lined 30. The spring straps 26, just as the backward spring tongues 13, can be molded onto the shifter collar 5. In the working example shown here, the spring straps 26 are in the form of parts set onto the shifter collar 5 and connected therewith by glueing. As can best be seen in FIG. 3, in order to achieve a great inherent elasticity, the spring arms forming the holding jaws 4 have stiffening ledges 32 which pass between the lateral teeth lines 30 and are tapered at the front and back ends. In the working example shown here, the teeth lines 30 are simply cut into the lateral edges of the stiffening ledges 32. The stiffening ledges 32 make sure that the spring arms forming the holding jaws 4 can virtually only be bent at their contact cross section with the shifter collar 5. The bendable part of the spring straps 26 is between the bridges 27 and their fixation to the shifter collar 5.

In the normal position of FIG. 1, both the axial locking gear 12 and the radial locking gear 25 are in engagement. When from this position on the control element 6 is moved forwards, first the spring tongues 13 jutting out at the back are spread and therefore the axial locking gear 12 is released. With the control element 6 being moved further forwards, the shifter collar 5 is taken along. The actuating dogs 31 are so arranged that they engage with the butting faces 21 before the lateral edges 24 of the holding jaws 4. The shifter collar 5 being moved further forwards causes the actuating dogs 31 to abut the butting faces 21 of the shank 1 reaching under them, so releasing the radial locking gear 25. As the shifter collar 5 is moved further forwards, the lateral edges 24 of the holding jaws 4 abut the lateral edges of the butting faces 21 of the shank 1 so spreading the spring arms forming the holding jaws 4. When, by means of the control element 6, the shifter collar 5 is moved backwards, these procedures take place in reverse order and direction with the holding jaws 4 possibly engaging with the head 9 of a screw 10, as can be seen in FIG. 3.

The control element 6 can be moved by hand in both directions. In the working example of FIG. 2, the control element 6 is supported on the shank 1 by means of a return spring 33 placed inside the handle 2. For this purpose, the shank 1 has a radially projecting pin 34 which passes through a cooperating axial slit 35 of the end of the sleeve forming the control element 6 engaging with the handle 2, and on which is supported the front end of the return spring 33 surrounding the sleeve which forms the control element 6. Due to the pin slit connection of this design, there is the simultaneous advantage of the control element 6 and the shifter collar 5 joined thereto being secured against turning on the shank 1. The back end of the return spring 33 is supported on a spring stop 36 of the sleeve, which at a distance reaches behind the pin 34 and in this case is simply in the form of a surrounding ring of the sleeve forming the control element 6.

The shank 1 can be firmly connected with the handle 2. In the working example shown here, in order to facilitate use there is an interposed free running locking gear 37 which, by means of a switch knob 38 can be changed from clockwise to counter-clockwise driving and vice versa. As can further be seen in FIGS. 1 and 2, for making use even easier, the handle 2 can have an unfoldable rocking lever 39 which, in its unfold position, serves as a lever arm for inducing a great torque, as is indicated by broken lines in FIG. 1.

So far, a working example of a particularly favored design has been dealt with in detail without, however, imposing any restrictions. There are rather quite a few possibilities for the expert to adapt the general outline of the invention to the needs of the particular situation. So for example, frictional locking gears can be used instead of the form-closed locking gears provided in the working example.

I claim:

1. A screw driver, comprising:

an elongated shank having a turning tool located at one end and a handle connected at its other end, said shank having butting faces defined at the turning tool end thereof;

a radial locking gear located at the turning tool end of the shank;

a shifter collar mounted on the shank at the turning tool end thereof for axial movement along the shank, said shifter collar including at least two spring arms serving as holding jaws, said spring arms being spreadable in the radial direction of the shank against their inherent elasticity by selected butting faces of the shank, and fixed relative to each other by means of said radial locking gear, said radial locking gear being mounted on the shifter collar and cooperating with other butting faces of the shank to release the spring arms;

a control element mounted on the shank at the handle end thereof and extending toward and engaging the shifter collar, said control element being mounted for axial movement along the shank and for imparting to the shifter collar its axial movement, said control element having butting faces at the turning tool end thereof; and an axial locking gear mounted to the shifter collar and the control element which fixes the shifter collar to the shank and connects the shifter collar to the control element, said axial locking gear cooperating with the butting faces of the control element for releasing the shifter collar from its fixed engagement with the shank.

2. The screw driver as defined in claim 1, wherein the control element is formed as a sleeve surrounding the shank, and wherein the axial locking gear includes a longitudinally extending guide slit in said control element and axially spaced stops.

3. The screw driver as defined in claim 2, wherein the shifter collar includes at least one spring ledge extending toward the handle end of the shank, said at least one spring ledge including a guide jaw, and wherein the sleeve includes a hole for each spring ledge for receiving the guide jaw of its respective spring ledge.

4. The screw driver as defined in claim 1, wherein the shank includes a longitudinally extending series of teeth the length of which defines the limit of travel of the shifter collar, and wherein the shifter collar includes at least one spring tongue extending toward the handle end of the shank, said at least one spring tongue being adapted to engage a butting face of the control element and having a locking tooth attached thereto which cooperates with the series of teeth, said longitudinally extending series of teeth, said at least one spring tongue and the associated butting face of the control element forming said axial locking gear.

5. The screw driver as defined in claim 4, wherein the shifter collar includes two spring tongues each with a locking tooth, and wherein two longitudinally extending series of teeth are provided which are staggered relative to each other by half a tooth space.

6. The screw driver as defined in claim 5, wherein the spring tongues have chamfered wedgelike surfaces at their free ends, and wherein the control element includes a longitudinally extending guide slit which receives the spring tongues, said guide slit defining at its closed end the butting faces of the control element which are chamfered and wedgelike in form and which are engaged by the chamfered and wedgelike surfaces of the spring tongues.

7. The screw driver as defined in claim 1, wherein the control element comprises a sleeve surrounding the shank, and a ring portion near the handle end of the shank which is set off from the handle.

8. The screw driver as defined in claim 1, further comprising:

a return spring for the control element situated at the handle end of the shank and engaging the shank and control element.

9. The screw driver as defined in claim 8, wherein the shank includes a projecting pin at its handle end, the control element includes a spring stop and an axial slit, wherein the projecting pin extends through the axial slit in the control element spaced from the spring stop, and wherein the return spring extends between the projecting pin and the spring stop.

10. The screw driver as defined in claim 1, wherein the shifter collar further includes two spring arms, a spring strap and at least one bridge situated at the front end of the spring strap and between the spring arms, said at least one bridge having a locking tooth at a lateral end thereof, and wherein at least one spring arm includes a laterally extending series of teeth, the lateral extent of which defines the limit of radial travel of the spring arms, said locking tooth cooperating with the series of teeth, said spring strap being adapted to engage a cooperating one of said other butting faces of the shank, and said laterally extending series of teeth, said spring strap, said at least one bridge and said corresponding one of said other butting faces forming said radial locking gear.

11. The screw driver as defined in claim 10, wherein said at least one spring strap has an inwardly projecting actuating dog which cooperates with one of said other butting faces of the shank.

12. The screw driver as defined in claim 10, wherein each spring arm includes a laterally extending series of teeth, and wherein two spring straps are provided situated opposite each other, each spring strap having two bridges each having a locking tooth which engages the laterally extending series of teeth.

13. The screw driver as defined in claim 12, wherein each spring strap has an inwardly projecting actuating dog which cooperates with a respective one of the other butting faces of the shank.

14. The screw driver as defined in claim 1, wherein the two spring arms are situated opposite to each other, and wherein the shank widens convexly outwardly at its front end between the spring arms and is formed flat.

15. The screw driver as defined in claim 1, wherein the shank has convexly shaped lateral edges at its turning tool end, and wherein the shifter collar includes two spring arms which converge in the form of wedgelike narrowing slits engaged by said lateral edges.

16. The screw driver as defined in claim 1, wherein the shifter collar includes two spring arms, and wherein each spring arm has at least one stiffening ledge which is tapered at its front and back ends.

17. The screw driver as defined in claim 1, wherein the shifter collar includes two spring arms each having an undercut forming a claw at its front end.

18. The screw driver as defined in claim 1, further comprising:

an unfoldable rocking lever connected at its handle.

19. The screw driver as defined in claim 1, further comprising:

a free running locking gear for connecting the handle to the shank, said free running locking gear being adapted to be switched over.

* * * * *